US008196913B2

(12) United States Patent
Lee

(10) Patent No.: US 8,196,913 B2
(45) Date of Patent: Jun. 12, 2012

(54) CLAMPING ASSEMBLY FOR CLAMPING STRINGS OF STRINGING MACHINE FOR SPORT RACKETS

(76) Inventor: Min-Wei Lee, Dali (TW)

( * ) Notice: Subject to any disclaimer, the term of this patent is extended or adjusted under 35 U.S.C. 154(b) by 485 days.

(21) Appl. No.: 12/480,367

(22) Filed: Jun. 8, 2009

(65) Prior Publication Data

US 2010/0308522 A1 Dec. 9, 2010

(51) Int. Cl.
*B25B 1/00* (2006.01)

(52) U.S. Cl. ..... 269/90; 269/89; 269/88; 473/555; 473/556; 473/557

(58) Field of Classification Search ..... 269/88–90; 473/555–557; 292/256, 336.3, 347, 348, 292/DIG. 37, 163, 173
See application file for complete search history.

(56) References Cited

U.S. PATENT DOCUMENTS

| | | | | |
|---|---|---|---|---|
| 5,090,697 | A * | 2/1992 | Lee | 473/555 |
| 6,093,121 | A * | 7/2000 | Bishop et al. | 473/557 |
| 6,398,674 | B2 * | 6/2002 | Tsuchida | 473/557 |
| 6,533,687 | B1 * | 3/2003 | Lee | 473/557 |
| 6,764,418 | B1 * | 7/2004 | Lee | 473/557 |
| 7,252,606 | B1 * | 8/2007 | Lee | 473/557 |
| 7,468,011 | B2 * | 12/2008 | Tsuchida | 473/557 |
| 2005/0022622 | A1 * | 2/2005 | Mitteer | 74/473.3 |

* cited by examiner

*Primary Examiner* — George Nguyen

(57) ABSTRACT

A clamping assembly for stringing machine includes a slide member, a positioning device, a control device and a rail. The positioning device and a tube are located on two ends of the slide member. The control device includes a pin, a ring-shaped member and a knob. The pin is pivotably connected with the knob. The tube includes an engaging section and a receiving section. The receiving section has a positioning pin and a spring which biases the positioning pin so as to move the positioning pin axially. The knob having a pin hole defined in an underside thereof and can be securely positioned by inserting the insertion member into the pin hole. The knob includes a release button which is connected with a bolt. When pressing the release button, the bolt moves the insertion member which releases the knob.

5 Claims, 8 Drawing Sheets

CLAMPING ASSEMBLY FOR CLAMPING STRINGS OF STRINGING MACHINE FOR SPORT RACKETS

FIELD OF THE INVENTION

The present invention relates to a clamping assembly device, and more particularly, to a clamping assembly for clamping strings of stringing machine for sport rackets.

BACKGROUND OF THE INVENTION

A conventional clamping assembly of stringing machine is shown in FIG. 1 and generally includes a body 11, a tapered member 12, a base 13, a knob 14 and a slide block 15. The body 11 has a tapered hole 111, a recess 112 and a tube 113 which extends upward from the body 11. The tapered member 12 is engaged with the tapered hole 111 and a protrusion 121 and a stop block 122 are fixed to an underside of the tapered member 12 so as to be connected to the rail of the stringing machine. The tube 113 receives the clamping assembly which is not shown. The base 13 is engaged with the recess 112 and includes a shaft 131 which has an eccentric section 132. A notch 133 is defined in the base 13 and located corresponding to the notch 133. The knob 14 is connected to a top of the shaft 131. A slot 114 is defined between the tapered hole 111 and the recess 112 so that the slide block 15 is engaged with the slot 114. The slide block 15 has a bolt 151 at an end thereof and the bolt 151 faces the recess 112 so as to be in contact with the eccentric section 132 of the shaft 131. A cap 152 is mounted to the contact surface between the bolt 151 and the eccentric section 132. The slide block 15 has an inclined surface 153 which is in contact with tapered member 12 and matches with the tapered member 12.

When positioning the body 11 to prevent the clamping assembly from shifting, the knob 14 is rotated so that the eccentric section 132 pushes the bolt 151 and the slide block 15 moves horizontally such that the tapered member 12 is pushed upward by the inclined surface 153. The stop block 122 is in contact with the rail 19 so that the body 11 is positioned and does not rotate. When the body 11 is to be released from the position, the knob 14 is rotated in opposite direction and the torsion spring 141 in the knob 14 rotates the knob 14 at high speed and back to its original position. The eccentric section 132 of the shaft 131 is not in contact with the bolt 151 so that the stop block 122 is disengaged form the rail 19. The tapered member 12 is lowered due to the gravity and the body 11 is freely rotated and moved along the rail 19.

It is noted that when the knob 14 is rotated to secure the body 11, during the stringing processes, the knob 14 might be rotated unintentionally by the user. Because the clamping assembly does not have a positioning feature, the knob 14 is easily rotated in opposite direction by the torsion spring 141. This shortcoming makes stringing machine to be un-reliable.

Another clamping assembly known to applicant is shown in FIGS. 2 to 4, the clamping assembly comprises a slide member 21, a positioning device 22, a control device 23 and a rail 24. The rail 24 is located at a top of the stringing machine and a slot 242 is defined in the rail 24. The positioning device 22 is located at an end of the slide member 21 and a tube 211 is located at the other end of the slide member 21. An extension 282 of a clamping device 28 is inserted into the tube 211. The control device 23 is located between the positioning device 22 and the tube 211.

The positioning device 22 includes a tapered cap and a stop block 222, wherein the diameter of the cap is reduced gradually from the top to the bottom so that the cap has a tapered outer surface. The cap is slidably engaged with the slot 242 of the rail 24. The stop block 222 is connected to the cap from the underside of the rail 24 by bolts so that the cap moves the stop block 222 which can position the slide member 21.

The control device 23 includes a pin 231, a ring-shaped member 232 and a knob 233. The ring-shaped member 232 is connected to the slide member 21 and the pin 231 is rotatably connected to the ring-shaped member 232. The pin 231 is connected to the knob 233. The ring-shaped member 232 includes a torsion spring 234 which is connected between the slide member 21 and the knob 233 so as to provide a force to return the knob 233.

The tube 211 includes an engaging section 2112 and a receiving section 2114. The receiving section 2114 is inserted into the pivotal hole 216 in the slide member 21 and the stepped lower end of the engaging section 2112 in contact with a top of the slide member 21.

The receiving section 2114 has a positioning pin 217 and a spring 218 which biases the positioning pin 217 such that the positioning pin 217 moves axially. The tube 211 has a slit 2115 which is located in the receiving section 114. The slide member 21 has an insertion slot 219 which communicates with the pivotal hole 216. The insertion slot 219 extends to an underside of the knob 233. The positioning pin 217 includes a piece 2172 and an insertion member 2174. The piece 2172 is received in the receiving section 2114 and the insertion member 2174 is engaged with the insertion slot 219. The piece 2172 and the insertion member 2174 are connected with each other by connection portion 2173 which is pivotably engaged with the slit 2115. The knob 233 is secured by inserting the insertion member 2174 into the pin hole 2334 to prevent the knob 233 from returning unintentionally.

By releasing the clamping device 28 to release the strings, the extension 282 of the clamping device 28 presses the piece 2172 due to the gravity to the clamping device 28 and the positioning pin 217 is then lowered to release the stop status to the knob 233. By rotation of the torsion spring 234, the knob 233 and the pin 231 are returned. The stop block 222 is longer contacts against the rail 24 and the slide member 21 can be rotated and shift to achieve the purpose of adjustment of the clamping device 28. It is noted that the clamping device 28 includes two ridge-groove on two sides thereof so as to firmly clamp the strings. Nevertheless, the clamping device 28 cannot lowered by the gravity because of the ridge-groove surfaces, and the positioning pin 217 cannot release the knob 233. The users then have to adjust the clamping device 28 and the positioning pin 217, this increases the time required to string the sport rackets.

The present invention intends to provide a clamping assembly to improve the shortcoming mentioned above so that the stringing machine is more reliable.

SUMMARY OF THE INVENTION

The present invention relates to a clamping assembly for stringing machine, wherein the clamping assembly comprises a slide member, a positioning device, a control device and a rail. The rail is located at a top of the stringing machine and a slot is defined in the rail. The positioning device is located at an end of the slide member and a tube is located at the other end of the slide member. The control device includes a pin, a ring-shaped member and a knob. The ring-shaped member is engaged with the slide member and the pin is pivotably connected with the ring-shaped member. The pin is pivotably connected with the knob. An annular space is defined in a top of the ring-shaped member and a torsion spring is received in the annular space. Two ends of the torsion spring are connected to the slide member and the knob respectively.

The knob has a pin hole defined in an underside of the knob and the slide member has a pivotal hole. The tube includes an engaging section and a receiving section. The engaging section is inserted into the insertion hole and a lower end of the engaging section is in contact with a top of the slide member. The receiving section has a positioning pin and a spring which biases the positioning pin so as to move the positioning pin axially. The tube has a slit which is located in the receiving section. The slide member has an insertion slot which communicates with the pivotal hole. The insertion slot extends to an underside of the knob. The positioning pin includes a piece and an insertion member. The piece is received in the receiving section and the insertion member is engaged with the insertion slot. The piece and the insertion member are connected with each other by connection portion which is pivotably engaged with the slit. The knob is secured by inserting the insertion member into the pin hole.

The knob further includes a release button and a bolt wherein the button is located corresponding to the pin hole. The bolt has a first end connected with the release button and a second end of the bolt extends through the knob and extends through the pin hole. The insertion member is removed from the pin hole by pushing the release button which pushes the bolt to move the insertion member so that the positioning pine releases the knob.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
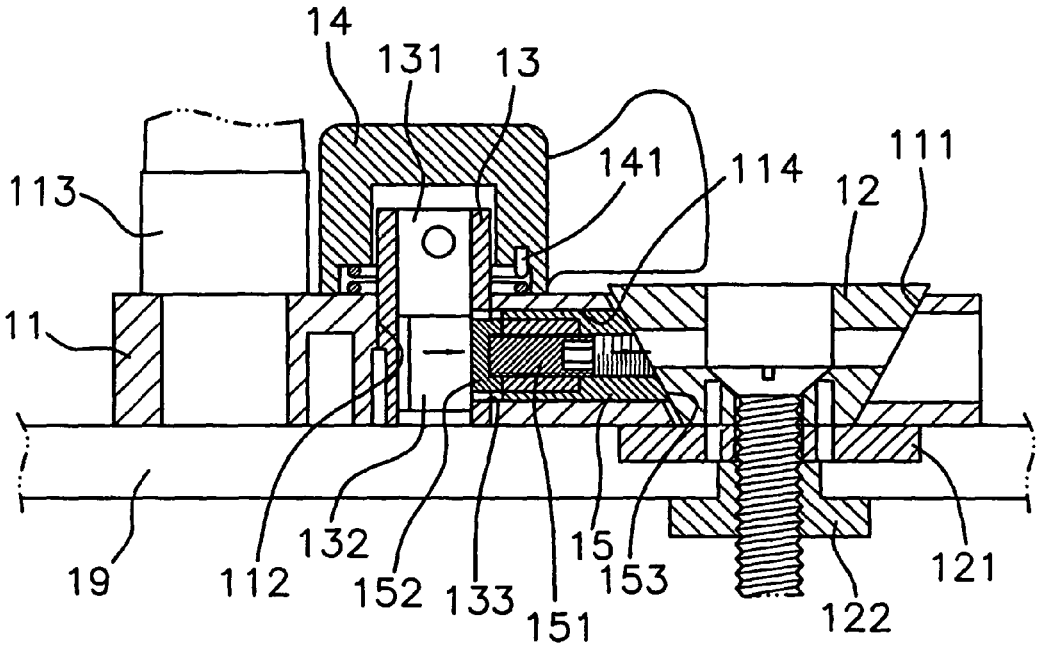
FIG. 1 PRIOR ART
FIG. 1 shows a conventional clamping assembly of stringing machine.
Figure 2:
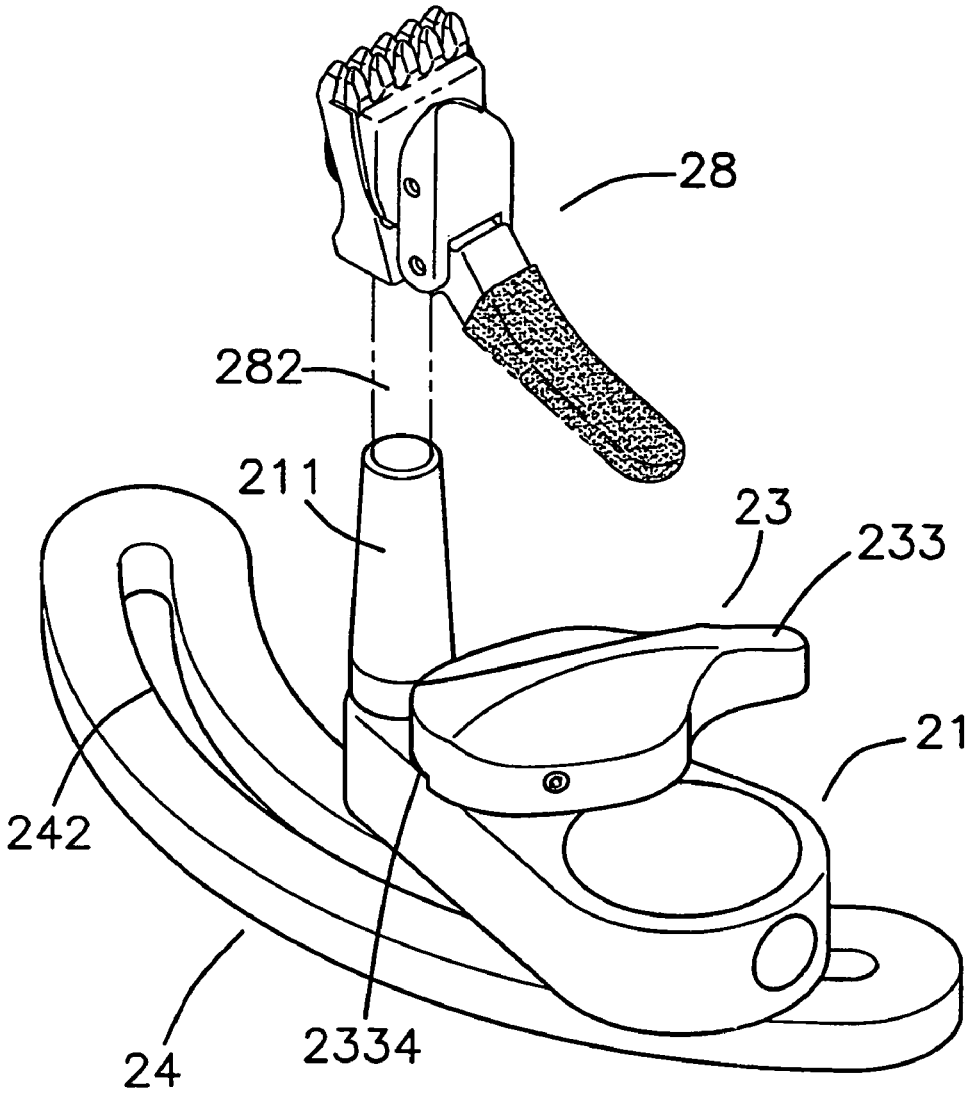
FIG. 2 PRIOR ART
FIG. 2 is a perspective view to show another conventional clamping assembly of the present invention.
Figure 3:
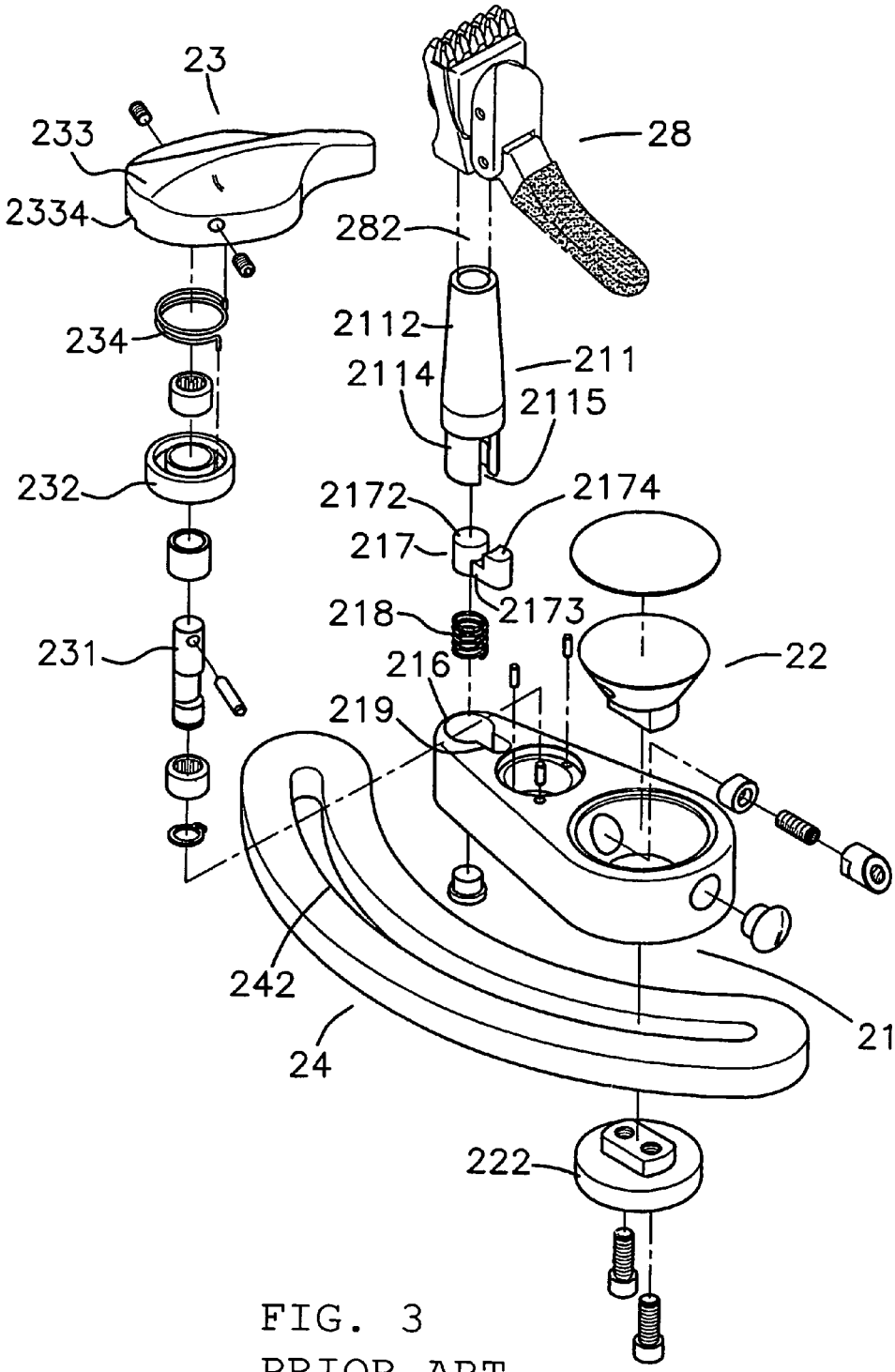
FIG. 3 PRIOR ART
FIG. 3 is an exploded view to show the conventional clamping assembly in FIG. 2.
Figure 4:
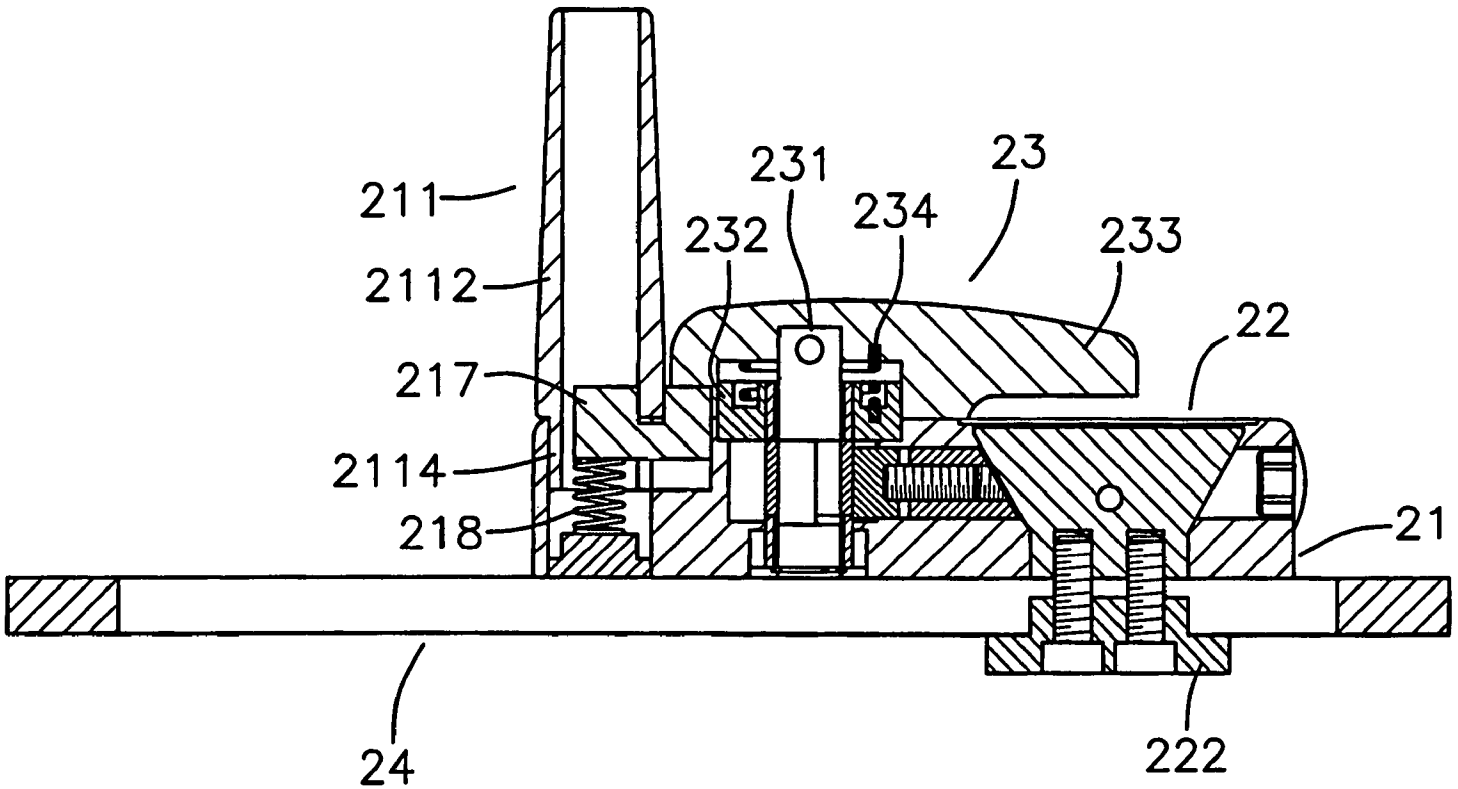
FIG. 4 PRIOR ART
FIG. 4 is a side cross sectional view of the conventional clamping assembly in FIG. 2.
Figure 5:
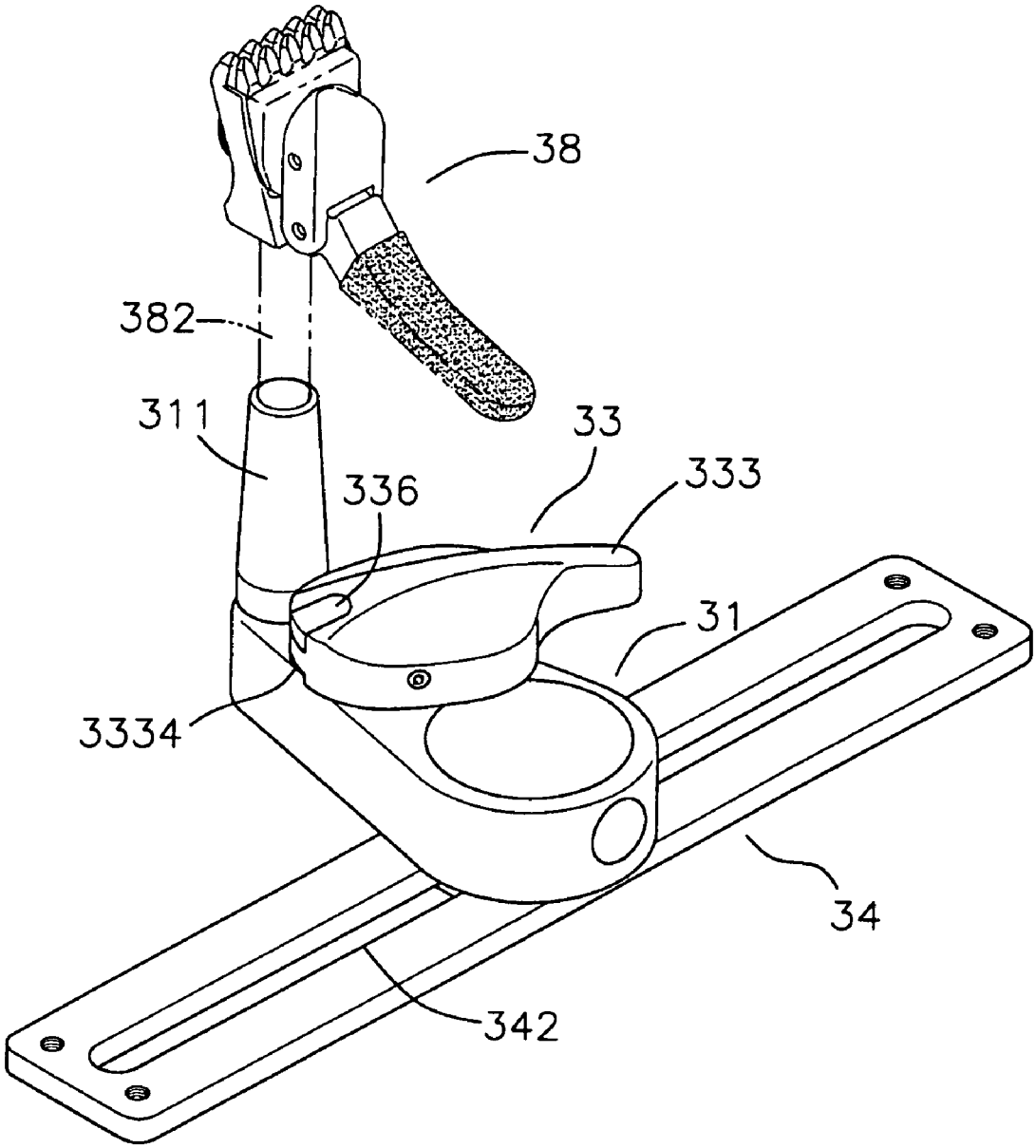
FIG. 5 is a perspective view to show the clamping assembly of the present invention.
Figure 6:
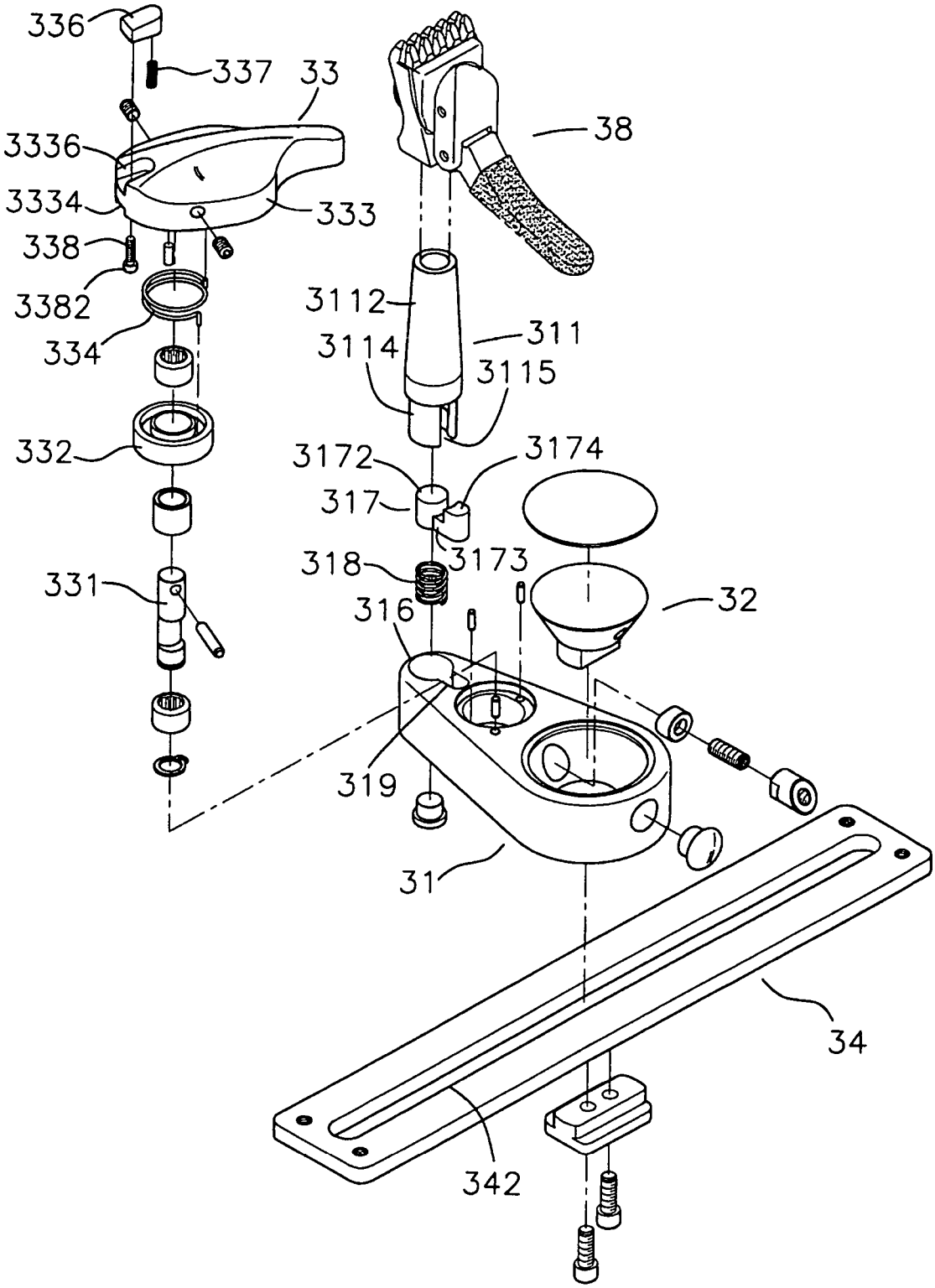
FIG. 6 is an exploded view to show the clamping assembly of the present invention.
Figure 7:
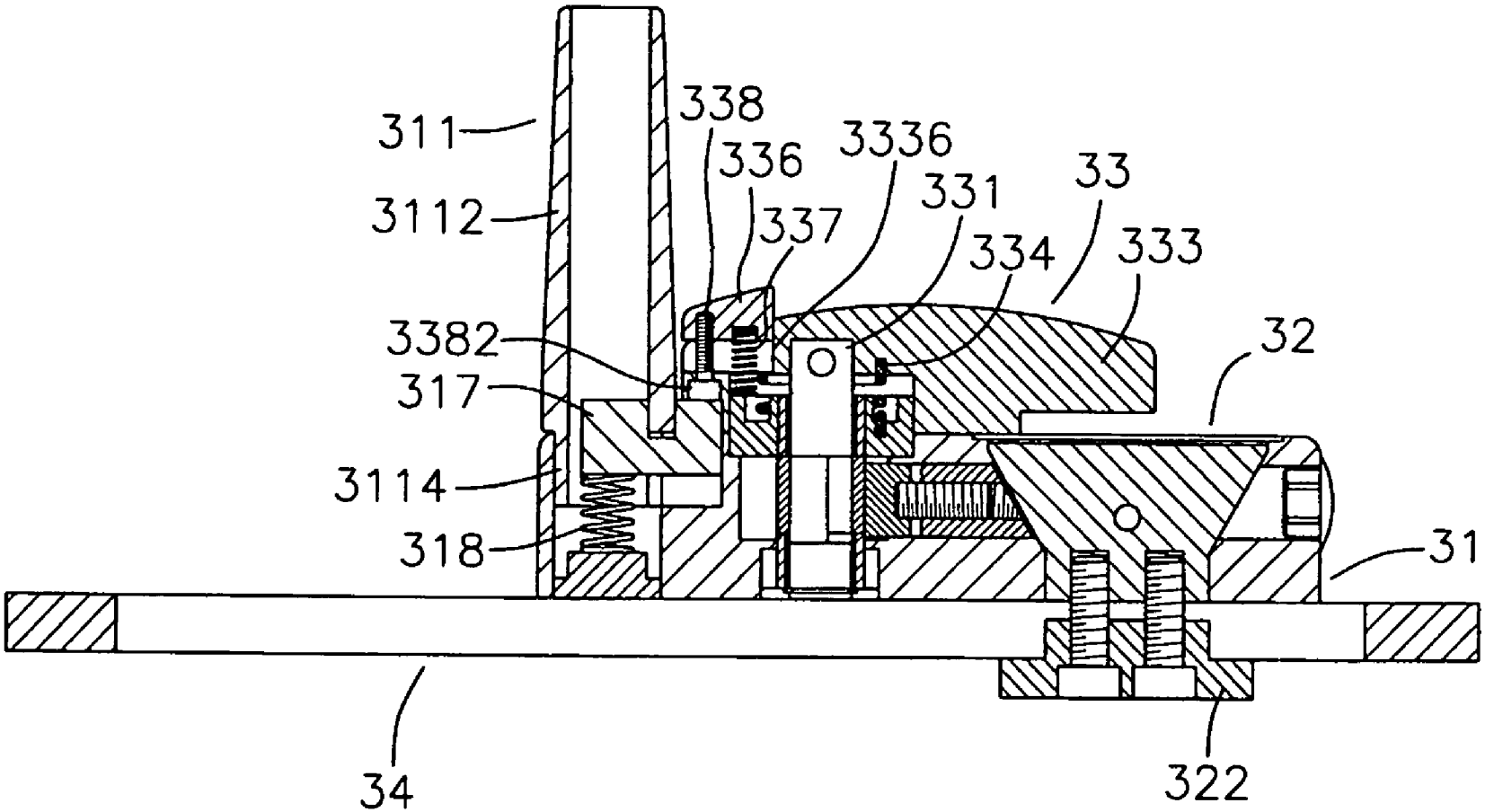
FIG. 7 is a side cross sectional view of the clamping assembly of the present invention.

Referring to FIGS. 5 to 7, the clamping assembly of stringing machine of the present invention comprises a slide member 31, a positioning device 32, a control device 33 and a rail 34. The rail 34 is located at a top of the stringing machine and a slot 342 is defined in the rail 34. The positioning device 32 is located at an end of the slide member 31 and engaged with the slot 342. A tube 311 is located at the other end of the slide member 31. An extension 82 of a clamping device 38 is inserted into the tube 311. The control device 33 is located between the positioning device 32 and the tube 311.

The control device 33 includes a pin 331, a ring-shaped member 332 and a knob 333. The ring-shaped member 332 is engaged with the slide member 31 and the pin 331 is pivotably connected with the ring-shaped member 332. The pin 331 is pivotably connected with the knob 333. An annular space is defined in a top of the ring-shaped member 332 and a torsion spring 334 is received in the annular space. Two ends of the torsion spring 334 connected to the slide member 31 and the knob 333 respectively, so that the knob 333 has a force to return it to its original position.

The knob 333 has a pin hole 3334 defined in an underside thereof and the slide member 31 has a pivotal hole 316. The tube 311 includes an engaging section 3112 and a receiving section 3114, wherein a lower end of the engaging section 3112 is in contact with a top of the slide member 31. The receiving section 3114 has a positioning pin 317 and a spring 318 which biases the positioning pin 317 so as to move the positioning pin 317 axially. The tube 311 has a slit 3115 which is located in the receiving section 3114. The slide member 31 has an insertion slot 319 which communicates with the pivotal hole 316. The insertion slot 319 extends to an underside of the knob 333. The positioning pin 317 includes a piece 3172 and an insertion member 3174, wherein the piece 3172 is received in the receiving section 3114 and the insertion member 3174 is engaged with the insertion slot 319. The piece 3172 and the insertion member 3174 are connected with each other by connection portion 3173 which is pivotably engaged with the slit 3115. The insertion member 3174 is inserted into the pin hole 3334 so as to secure the knob 333.

The knob 333 further includes a release button 336 and a bolt 338, wherein the knob 333 includes a reception hole 3336 in the top thereof and the release button 336 is received in the reception hole 3336. The button 336 located corresponding to the pin hole 3334. The bolt 338 has a first end connected with the release button 336 and a second end of the bolt 338 has a head 3382 which extends through the knob 333 and extends through the pin hole 3334 to presses the insertion member 3174. A spring 337 is located and biased between the release button 336 and the knob 333 so as to support the release button 336.

Figure 8:
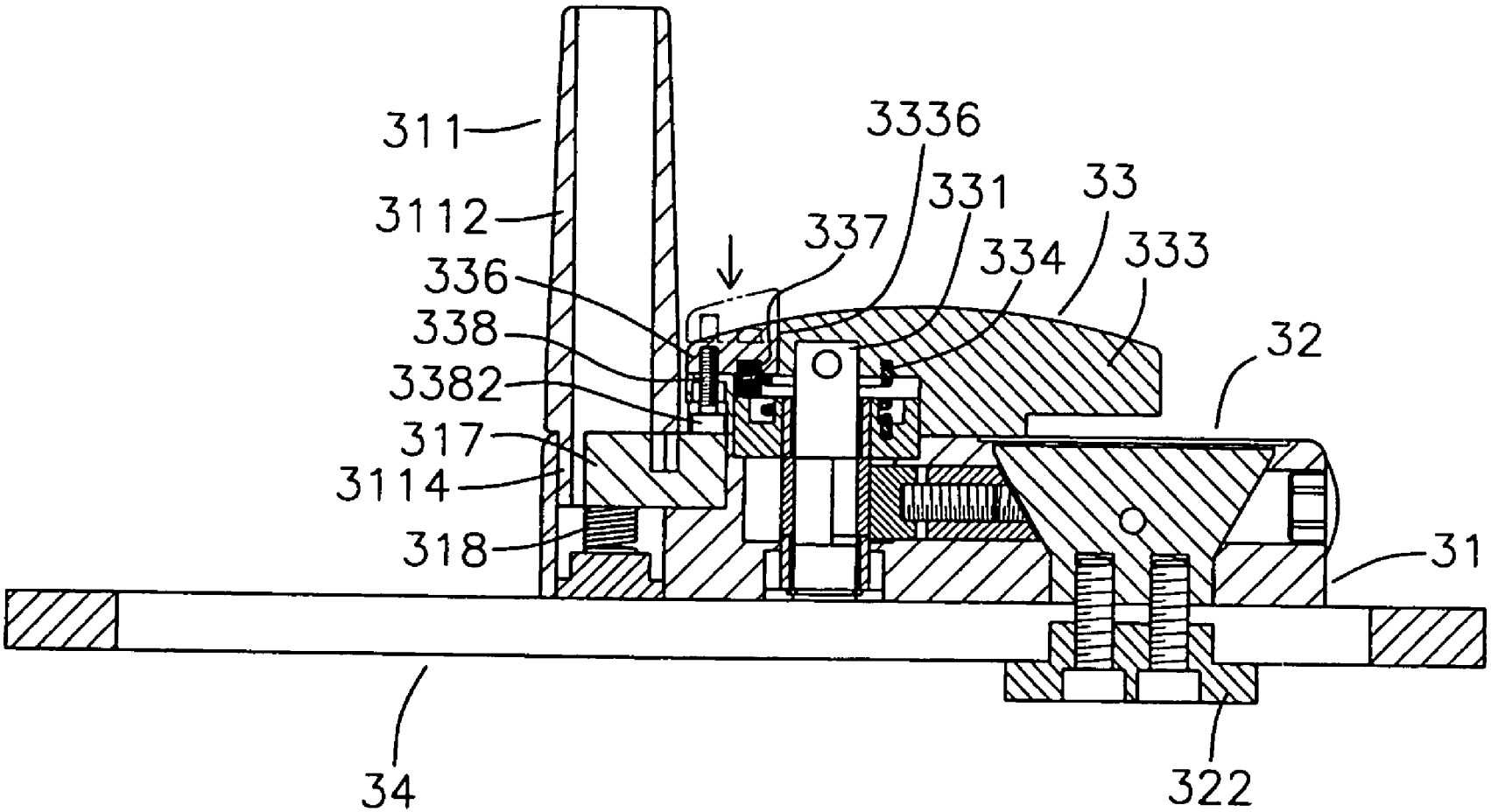
FIG. 8 shows a cross sectional view to show that the knob is released by pressing the release button.

Further referring to FIG. 8, when the user wants to release the knob 333 so as to adjust the clamping device 38, he can use the clamping device 38 to press the piece 3172 to force the positioning pin 317 to be lowered and therefore release the release button 336. The user can also use the bolt 338 to press the insertion member 3174 to release the knob 333. The insertion member 3174 is removed from the pin hole 3334 by pushing the release button 336 which pushes the bolt 338 to move the insertion member 3174 so that the positioning pine 317 releases the knob 333.

Even if the clamping device 38 is affected by the strings and cannot be lowered to press the piece 3172, the user can release the positioning device 32 from the rail 34 to easily adjust the clamping device 38.

While we have shown and described the embodiment in accordance with the present invention, it should be clear to those skilled in the art that further embodiments may be made without departing from the scope of the present invention.

What is claimed is:

1. A clamping assembly for stringing machine, comprising:

a slide member, a positioning device, a control device and a rail, the rail adapted to be located at a top of the stringing machine and a slot defined in the rail, the slide member movable along the slot, the positioning device located at an end of the slide member a tube located at the other end of the slide member, a clamping device inserted into the tube, the control device located between the positioning device and the tube;

the control device including a pin, a ring-shaped member and a knob, the ring shaped member engaged with the slide member and the pin pivotably connected with the ring-shaped member, the pin pivotably connected with the knob, an annular space defined in a top of the ring-shaped member and a torsion spring received in the annular space, two ends of the torsion spring connected to the slide member and the knob respectively;

the knob having a pin hole defined in an underside thereof and the slide member having a pivotal hole, the tube including an engaging section and a receiving section, a lower end of the engaging section being in contact with a top of the slide member, the receiving section having a positioning pin and a spring which biases the positioning pin so as to move the positioning pin axially, the tube having a slit which is located in the receiving section, the slide member having an insertion slot which communicates with the pivotal hole, the insertion slot extending to an underside of the knob, the positioning pin including a piece and an insertion member, the piece received in the receiving section and the insertion member engaged with the insertion slot, the piece and the insertion member being connected with each other by connection portion which is pivotably engaged with the slit, the insertion member inserted into the pin hole so as to secure the knob and prevent the knob from rotating accidentally, and the knob including a release button and a bolt, the button located corresponding to the pin hole, the bolt having a first end connected with the release button and a second end of the bolt extending through the knob and extending through the pin hole, the insertion member being removed from the pin hole by pushing the release button which pushes the bolt to move the insertion member so that the positioning pin releases the knob.

2. The assembly as claimed in claim 1, wherein a spring is located between the release button and the knob so as to support the release button.

3. The assembly as claimed in claim 2, wherein the spring is biased between the knob and the release button.

4. The assembly as claimed in claim 1, wherein the knob includes a reception hole in the top thereof and the release button is received in the reception hole.

5. The assembly as claimed in claim 1, wherein the bolt includes a head which presses the insertion member.

* * * * *